United States Patent [19]

Wingerter

[11] Patent Number: 5,037,016

[45] Date of Patent: Aug. 6, 1991

[54] APPARATUS FOR SUPPLYING WEB-LIKE MATERIAL TO A PROCESSING SYSTEM

[75] Inventor: Franz Wingerter, Berlin, Fed. Rep. of Germany

[73] Assignee: Klussendorf Aktiengesellschaft, Berlin, Fed. Rep. of Germany

[21] Appl. No.: 418,107

[22] Filed: Oct. 6, 1989

[30] Foreign Application Priority Data

Oct. 7, 1988 [DE] Fed. Rep. of Germany ..... 3834702

[51] Int. Cl.[5] ..... B41J 11/48; B41J 15/18

[52] U.S. Cl. ..... 226/110; 400/608; 400/605; 400/608.3; 101/66; 226/108

[58] Field of Search ..... 101/66; 226/108, 109, 226/110; 271/9; 400/605, 607, 608, 608.1, 608.3, 608.4

[56] References Cited

U.S. PATENT DOCUMENTS

| | | | |
|---|---|---|---|
| 3,921,878 | 11/1975 | Zangenfeind | 226/109 X |
| 4,390,296 | 6/1983 | Siegenthaler | 400/608 |
| 4,655,626 | 4/1987 | Okazaki | 400/605 |
| 4,827,841 | 5/1989 | White, Sr. | 400/605 X |
| 4,828,415 | 5/1989 | Hirono et al. | 400/605 |
| 4,895,288 | 1/1990 | Kotani et al. | 226/109 |

*Primary Examiner*—Daniel P. Stodola
*Assistant Examiner*—Paul Thomas Bowen
*Attorney, Agent, or Firm*—Weintraub, DuRoss & Brady

[57] ABSTRACT

An apparatus of the type for the supply of webs to a processing station is described, in which by means of a controllable drive mechanism, each of several webs is advanced to the processing station in superimposed guide channels. The front portion of the web, following processing, is cut from the web and the front end of the web, following separation, is retracted out of the processing station. For this purpose, the controllable drive mechanism can be selectively engaged with one web in the vicinity of the guide channel of the web for the complete forward and return transport of the web before and after a processing operation. The drive mechanism preferably has reversibly drivable rollers. For producing an engagement between a web and a drive roller the guide channels are preferably pivotable with respect to the rollers. The processing station is generally a printing means, in which, for example tickets of differing color are to be printed.

31 Claims, 3 Drawing Sheets

APPARATUS FOR SUPPLYING WEB-LIKE MATERIAL TO A PROCESSING SYSTEM

BACKGROUND OF THE INVENTION

1. Field of the Invention

The invention relates to an apparatus for the supply of webs, or web-like material, to a processing station. More specifically, the invention relates to an apparatus for selectively supplying one of several webs to a processing station.

2. Description of the Related Art

EP No. 0 048 329 B1 discloses a printing press with a roller pair for conveying a printing material web to be zonally printed, a springing means and a cutting off means for the printed web portion. This printing press is constructed to permit printing on a selected web of several available printing material webs, said webs being e.g., of varying widths, different colors or having different base tints. For this purpose, several flat guide channels are arranged in a fan-like manner for each one of the several printing material webs. The webs are directed to a side of the roller pair remote from the printing means. A single, drivable feed means is associated with each guide channel. The feed means is designed in such a way that, prior to the printing press, it pushes the printing material webs, which each project into one of the channels, along the channel. After the free web end enters the rotating roller pair, the feed means releases the web and the roller pair moves the web on into the printing position; then moves the web back following the severing of the web end. Before the web end formed by the severing leaves the roller pair, the web is again taken up by the feed means and pushed back by a distance, which is the same as the advance distance of the feed means along the channel.

This known printing press is relatively complicated. This press requires two conveying or transport means having matched controls, i.e., one each for the feed means and the pair of rollers.

The problem addressed by the present invention is the provision of an apparatus for the supply of web-like material to a processing station which has a simpler construction than the known printing press and which is therefore more advantageous both with regards to production and operation, including maintenance and reliability.

SUMMARY

An apparatus for supplying a web to a processing station is disclosed comprising:

(a) a first pivotal guide channel for directing a web, (b) a fixed transport roller for driving the web, the fixed transport roller located so as to drivingly contact the web within the guide channel when the guide channel is pivoted to the transport roller; and, (c) means for pivoting the first guide channel proximal to, and distal from the transport roller.

As the controllable drive mechanism can, as desired, be engaged with each web in the vicinity of the guide channel of the web for the complete forward and return transport of the web before and after a processing operation, there is no need for a conveying roller pair between the guide channels and the processing station.

The drive mechanism preferably has reversibly drivable transport rollers, which can be engaged with each of the webs as located in the guide channels. For producing an engagement between a web and at least one transport roller of the drive mechanisms, the guide channels are pivotable with respect to the transport rollers being proximal for driving the web, and distal for non-driven webs. This has the advantage in that when the transport rollers are mounted in a stationary manner only a slight pivoting of the guide channel is required for engaging the web with the drive mechanism.

A particularly simple construction of the apparatus is obtained in that each transport roller has associated guide channels on opposite sides thereof, those guide channels associated with one transport roller being pivotable by a common member, or actuator.

The invention is described in greater detail hereinafter relative to preferred embodiments and the attached drawings, wherein is shown.

DESCRIPTION OF THE PREFERRED EMBODIMENTS

Figure 1:
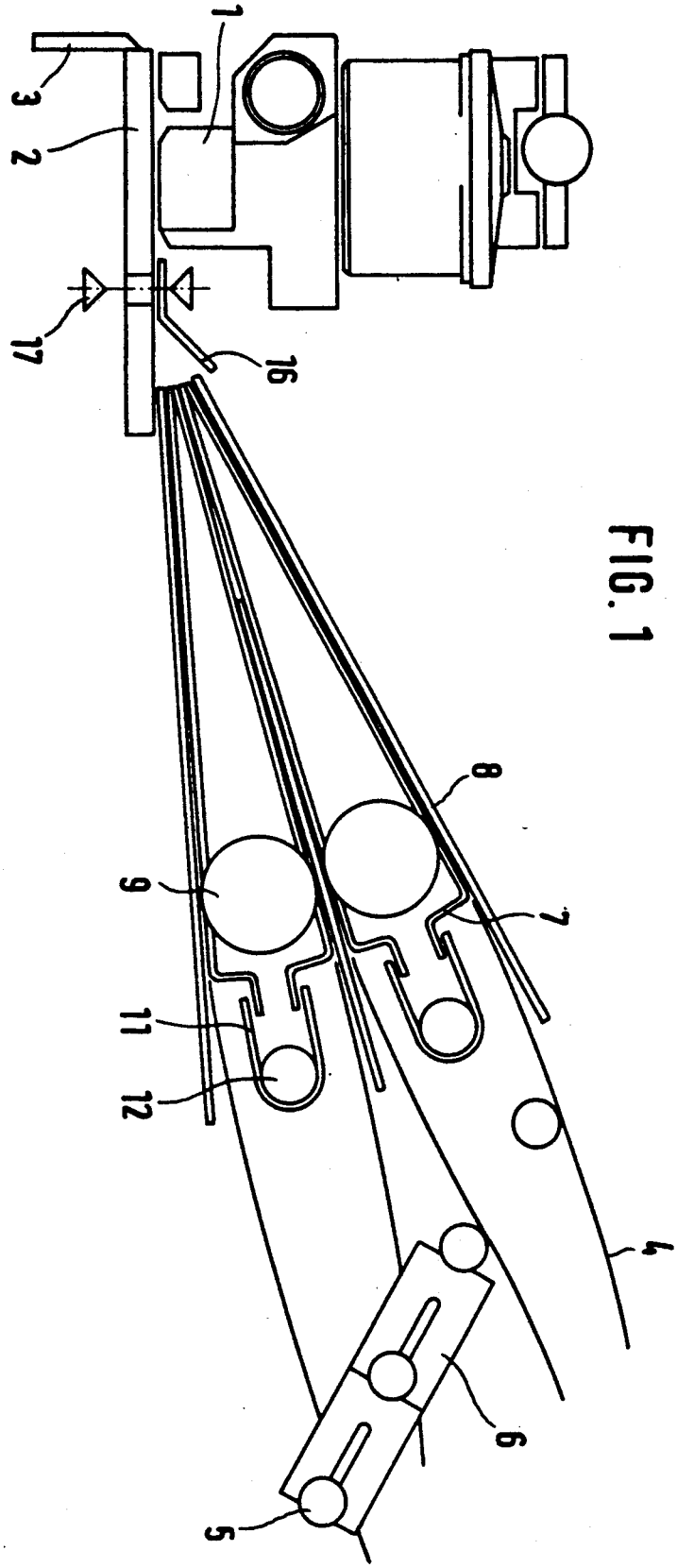
FIG. 1 is a simplified side view of a first embodiment of the apparatus in conjunction with a printing means.

As shown in FIG. 1, a web-processing station such as a conventional printing means is supplied from the right with a web 4 or other web-like material, such as paper, to be printed in the gap between the numbering box 1 and the clamping bar 2. The supply apparatus is suitable for supplying four different paper webs, only one of the four webs being individually advanced in a first direction to the printing means and the front portion thereof printed. Subsequently, the web is further advanced until the printed portion is to the left of a vertically movable cutting blade 3, which cuts this printed portion from the web 4. This web 4 is then retracted from the vicinity of the printing means in a second direction until the web front end is at the same distance from the printing means as the front ends of the other webs. The supply apparatus remains in this position until once again a web 4 is selected for printing and is processed in the above-described manner. The illustrated arrangement is e.g. used for producing tickets or the like differing in color.

The webs 4 are drawn from reels (not shown) and passed between cross-rods 5, between which are held riders 6 which are displaceable in the longitudinal direction thereof for the lateral guidance of the webs. Each web 4 is guided into a guide channel formed from two guide plates; a biassed or transport guide plate 7 and a solid or back guide plate 8. A guide channel passage is formed by that area between the two plates 7, 8 into, and through which, the web 4 travels. Each biassed guide plate 7 is adjacent to a transport or conveying roller 9 and back guide plate 8 is located on that guide channel side remote from the associated roller 9. All the transport guide plates 7 and back guide plates 8 are pivotally mounted about that end of the guide channel directed towards the printing means by fulcrums. The transport rollers 9 are reversibly drivable by stepping motors (not shown in FIG. 1) and are located between two guide channels which thereby form an operable guide channel pair.

Figure 2:
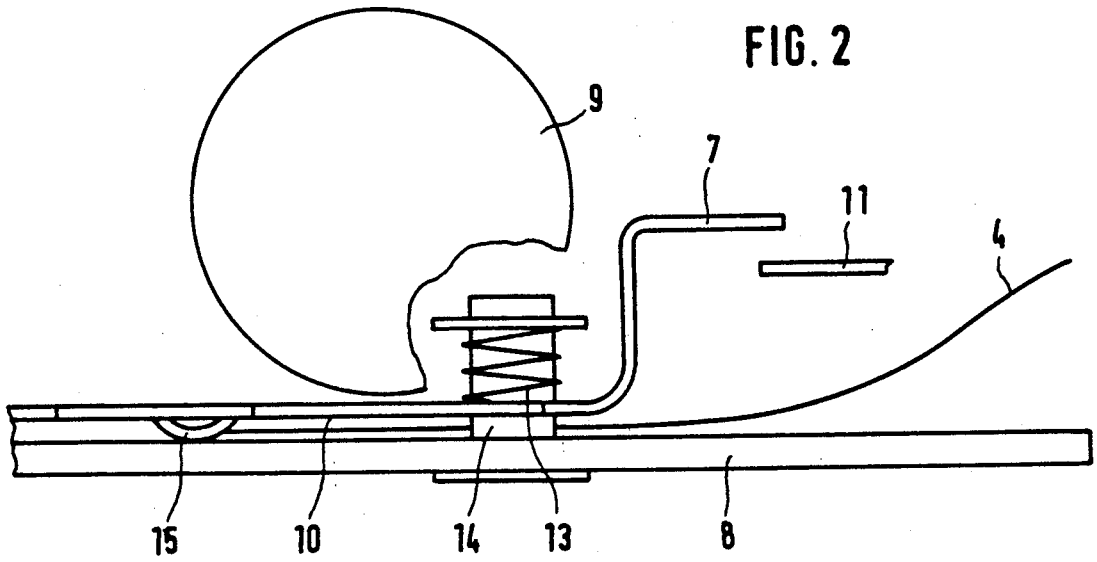
FIG. 2 is a larger-scale detail of FIG. 1.
Figure 4:
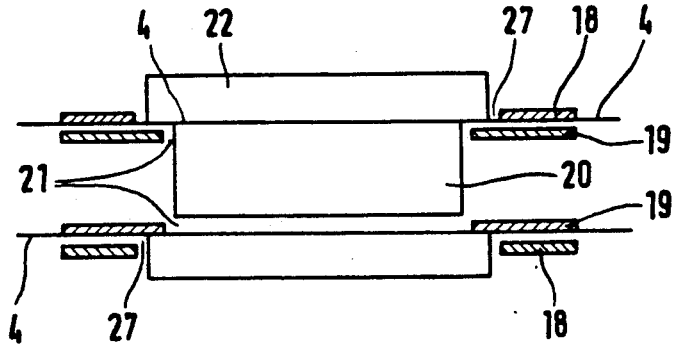
FIG. 4 is a section through a transport roller and two back pressure rollers along line IV—IV in FIG. 3.

As can be seen in FIG. 2, the biassed guide plate 7 contains an opening 10 through which the transport roller 9 passes if the biassed guide plate 7 is pivoted against the transport roller 9. The pivoting of the biassed guide plate 7 takes place by means of forked rockers 11, which are attached to controllable pivot pins 12. Each leg of the rocker 11 can be engaged with one of the biassed guide plates 7, the rotation direction of the rocker 11 determining which of the two associated biassed guide plates 7 is thereby pivoted against transport roller 9.

Biassed guide plates 7 and solid guide plates 8 are coupled together via a spring 13 which is carried by a base 14 passing through the biassed guide plate 7 and held by the solid guide plate 8. The spring 13 and the base 14 cooperate to define a means for resiliently coupling the biassed guide plates 7 and solid guide plates, 8 together and a means to bias the guide channel away from the transport roller 9. The spring 13 is held at the end of base 14 opposite to solid guide plate 8 so that it presses the solid guide plate 8. The minimum spacing between the biassed guide plates 7 and solid guide plates 8, is ensured by bead-like protuberances 15 attached to the biassed guide plate 7 and located across the guide channel passage for the paper web 4.

If a rocker 11 pivots a biassed guide plate 7 proximal to, or against the associated transport roller 9, then as a result of the connection of base 14, the solid guide plate 8 follows this pivoting movement. The transport roller 9 passes through an opening 10 in the biassed guide plate 7 and comes into contact with the solid guide plate 8 or the web 4 located in the guide channel between the biassed guide plates 7 solid guide plates, 8. On further pivoting of the biassed guide plate 7 the, solid guide plate 8 is secured by contact with the transport roller 9, so that the protuberances 15 are detached therefrom, thus opening the guide channel passage for the paper web 4 driven by the transport roller 9.

When arranged in superimposed fashion, as shown in FIG. 1, the guide channels are designed in such a way that two adjacent guide channels share a solid guide plate 8. The illustrated apparatus contains four guide channels, but the number thereof can be increased without difficulty, wherein one transport roller 9 and one rocker 11 are provided for two additional channels.

A common guide plate 16, located between the guide channels and the printing means is common to all the guide channels and ensures that each advanced paper web 4 is supplied in a completely satisfactory manner to the printing means. A scanning means, in the form of a light barrier 17, detects the front end of an advanced web 4, so that it is possible to generate control signals for the further precise forward and return transport of said web.

The illustrated supply apparatus functions as follows. Initially all the webs 4 are advanced into their associated guide channels until their front ends abut on the protuberances 15 serving as stops. No further advance is possible, because the protuberances 15 are pressed by springs 13 against the solid guide plates 8.

To print and separate the front portion of a web 4, a control signal is sent to the selected transport roller 9 to be driven in the correct rotational direction, and the associated rocker 11 is pivoted via the pivot pin 12 to contact the biassed guide plate 7 so that the guide channel containing the selected web 4 is moved towards transport roller 9. The transport roller 9 passes through the opening 10 in the biassed guide plate 7 and presses the web 4 against the solid guide plate 8.

Simultaneously, the protuberances 15 are detached from the solid guide plate 8 by the pivoting of the biassed guide plate 7, thereby opening the guide channel passage, so that the paper web 4 can be advanced by the rotating transport roller 9. The leading edge of the web is detected by the light barrier 17, so that there can be a positionally accurate control of the further movements of web 4. The web 4 is now positioned in the printing means the printing process is performed, and the printed portion is advanced over the cutting blade 3 and then separated from the web 4. In order to free the printing means for a next paper web 4 to be printed, the front end of the just printed web is retracted into its guide channel, by reversing the rotational direction of the transport roller 9. This retraction takes the leading edge of the web 4 to a clearly defined point in the guide channel located between the channel end facing the printing means and the protuberances 15. After stopping the transport roller 9, the rocker 11 is brought into its central position, so that the engagement of the transport roller 9 in the guide channel is removed and the web 4 is clamped by the protuberances 15, so that it cannot be unintentionally moved. The supply apparatus is then ready for supplying the next web 4 to the printing means.

The supply apparatus of FIG. 1 can also be constructed in such a way that the guide channels for the web-like material are not superimposed in fan-like manner, but instead, separately usable guide channels can be juxtaposed. This leads to a correspondingly adapted construction of the processing station and those web supply means elements cooperating with the guide channels.

Figure 3:
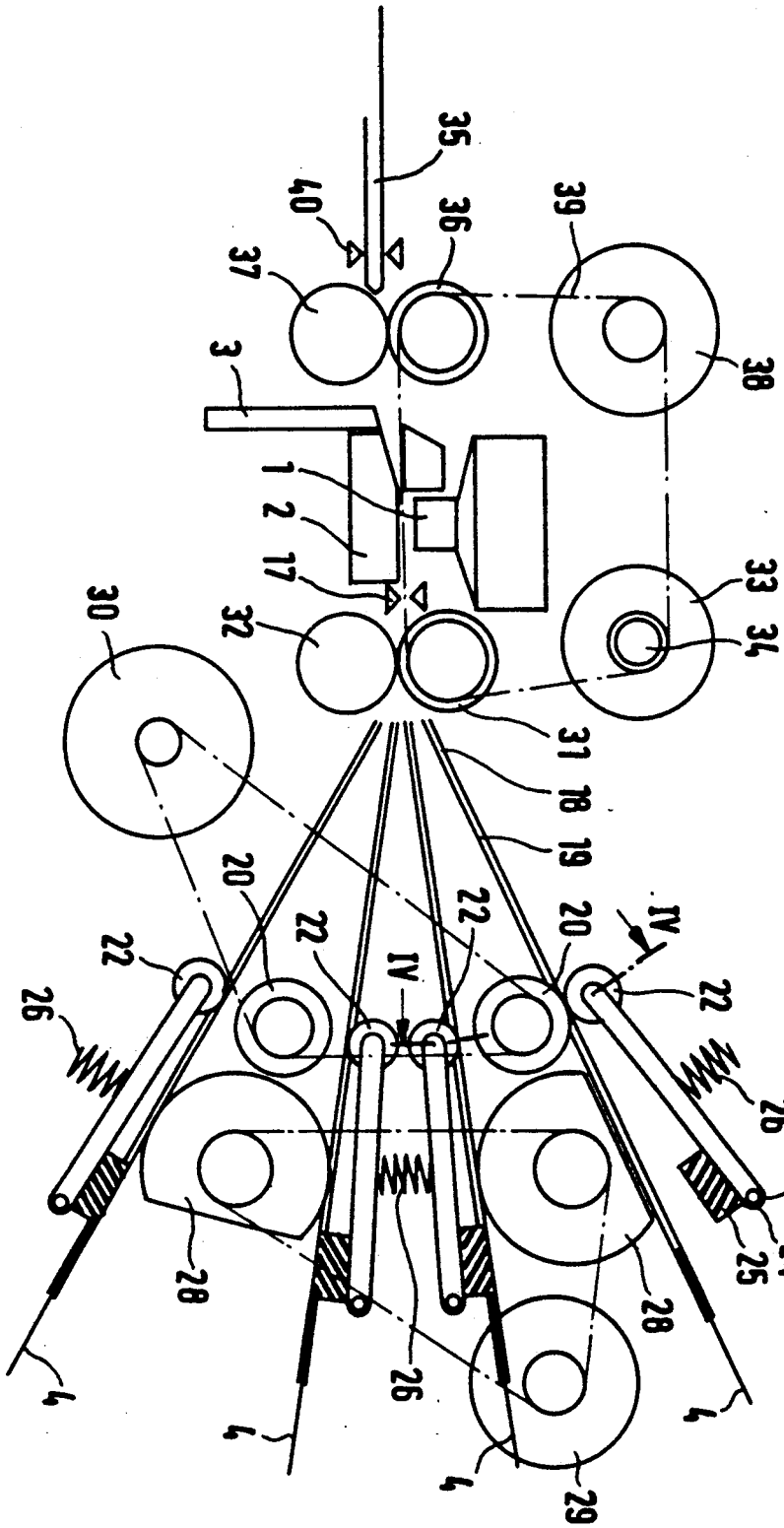
FIG. 3 is a simplified side view of a second embodiment of the apparatus in conjunction with a printing means.

FIG. 3 also shows a known printing means with a numbering box 1, clamping bar 2 and cutting blade 3. There are four superimposed guide channels, each supplying one paper web 4 to the printing means. Each guide channel is formed by a back or solid guide plate 18 and a transport or biassed guide plate 19 between which a web 4 is held in the guide channel passage. Each pair of guide plates 18, 19 is jointly pivotable about a fulcrum located at that end facing the printing means. A rotary transport roller 20 is fixed between each two adjacent guide channels with the transport guide plate 19 facing the transport roller 20. Each transport guide plate 19 of a guide channel pair has openings 21, facing the transport roller 20 so that in case of a corresponding pivoting of the back guide plates 18, the transport guide plate 19, the transport roller 20 passes through the opening 21 of transport guide plate 19 and is thereby brought into frictional contact with a web 4.

On the opposite side of each guide channel from the transport roller 20, a back pressure roller 22 faces the back guide plate 18 and the associated transport roller 20. Each back pressure roller 22 is rotatably mounted in one end of a lever 23, which is pivotable about a spindle 24 located on the other end. At this end, and on the side facing the associated guide channel, lever 23 carries a clamping rubber 25 to prevent movement of the web 4 when that guide channel is not in use. A spring 26 acts on the lever 23 as a means to bias rollers 22 towards their associated transport roller 20.

The back pressure rollers 22 are wider than the openings 21 in the transport guide plate 19. Therefore the back pressure roller 22 abuts the guide channel at transport guide plate 19 due to the bias of spring 26 acting on the lever 23. The interconnected guide plates 18, 19 of each guide channel are thereby biassed by spring 26 towards the transport roller 20.

The back guide plates 18 of the individual guide channels, wherein fits web 4, which are proximal to the levers 23, are provided with openings 27, which extend over the width of the back pressure roller 22 to allow passage of the back pressure roller through the back guide plate 18. The opening 27 also extends in the longitudinal direction over and beyond back pressure roller 22 and the clamping rubber 25, so that the clamping rubber 25 can be brought into contact with web 4 to prevent unintentional movement of the web 4.

With each guide channel pair is associated a cam-like selection roller 28 that enables the associated guide channels to be pivoted as cam-followers of the selection roller 28 rotation. All the selection rollers 28 are jointly driven by a stepping motor 29. The motor 29 and the belt together comprise a means for jointly driving the selection rollers 28. The selection rollers 28 are so constructed and moved with respect to one another that only one transport roller 20 can be engaged with one paper web 4 in one of the two associated guide channels of the guide channel pair; and in the other guide channels, the webs 4 are not in engagement with the associated transport roller 20. The stepping motor 29 is controlled so that it can be stopped in each position in which a transport roller 20 is engaged with a paper web 4, as well as in a further position, in which all the transport rollers 20 and webs 4 are non-engaged.

The selection rollers 28, located on the opposite side of the guide channels 53 from the back pressure rollers 22, prevent contact with transport rollers 20. As a function of the position of the selection rollers 28, only one of the guide channels (the top one in FIG. 3) can be pivoted by the action of the associated spring 26 to such an extent that the fixed transport roller 20 passes through the transport guide plate opening 21 to contact the web 4. Upon contact with the transport roller 20, the web 4 is pressed back between the pressure roller 22 and the transport roller 20 so that during rotation of the transport roller 20, the web 4 can be pushed forwards towards the printing means or drawn backwards. The inactive guide channels are kept spaced from the transport rollers 20 by the associated selection roller 28. The inactive guide channels are in contact with a clamping rubber 25, which passes through the opening 27 and presses the web 4 against the transport guide plate 19, so that the web is secured against unintentional movement.

If another web 4 is to be transported in another guide channel, then the stepping motor 29 is operated in such a way that the previous guide channel, which was in engagement with a transport roller 20, is pivoted away therefrom by its selection roller 28 whilst the newly selected guide channel is pivoted by spring 26 against the associated transport roller 20. The other guide channels will remain out of engagement with their transport rollers 20 due to the cam placement of the cam-like selection rollers 28 and the cam following action of the guide channels.

All the transport rollers 20 are driven jointly by a reversible motor 30, preferably constructed as a stepping motor. During a selection process, i.e. during the rotation of the selection rollers 28 by the stepping motor 29, the transport roller motor 30 is stopped.

The number of guide channels is not limited to four as in the construction according to FIG. 3. Further guide channels can be superimposed or juxtaposed. The pushing forward and drawing back of the paper webs 4 is controlled in the same way as in the embodiment according to FIG. 1 by a correspondingly controlled and driven transport roller 20, in engagement with the active guide channel.

The apparatus according to FIG. 3 also has a pair of draw-in rollers 31, 32, which do not have any transporting or conveying function, but instead, serve to fix the advanced web 4 at the intake of the printing means, so as to improve the printing quality by keeping the web taut during printing. The control of the paper advance and retraction is brought about exclusively by means of the transport rollers 20. The draw-in roller 31 is driven clockwise by a low power direct current (d.c.) motor 33. The d.c. motor 33 is designed in such a way that it drives the draw-in roller 31 somewhat more rapidly in the load-free state than the advance rate of web 4 advanced by transport roller 20. As a result of the friction action between web 4 and the draw-in roller 31, there is a certain deceleration of the d.c. motor 33, the web 4 thereby being held taut between the transport roller 20 and the draw-in rollers 31, 32.

A drive coupling 34 is located in the driving connection between the d.c. motor 33 and the draw-in roller 31 which interrupts the driving connection if a web 4 is drawn back by a transport roller 20, so that the d.c. motor 33 does not prevent or make difficult the retraction of the web.

The apparatus according to FIG. 3 also has a pinned-on alternative paper supply device for supplying an alternative web to the printing means outside the feed channels. This web is moved to the right on a feed table 35 against a pair of rollers 36, 37. Roller 36 is driven by a reversible stepping motor 38 via a driving belt 39, which also forms the driving connection between the d.c. motor 33 and the draw-in roller 31.

A second light barrier 40 detects the leading edge of the advanced web and brings about the switching on of the stepping motor 38 and the separation of the driving connection between the d.c. motor 33 and the driving belt 39 through the drive coupling 34. Roller 36 transports the web further to the right until its leading edge is detected by the light barrier 17 which controls transport motor 30. The reversible stepping motor 38 is stopped and the printing process is accomplished. The reversible stepping motor 38 is then rotated in the opposite direction, so that the paper is conveyed out of the printing means again.

Having, thus, described the invention what is claimed is:

1. An apparatus for supplying at least two webs to a processing station comprising:

(a) a plurality of pivotable back guide plates in combination with a plurality of pivotable transport guide plates, each one of the plurality of transport guide plates cooperating with a corresponding back guide plate to define a pivotable guide channel therebetween, each guide channel capable of containing and directing a separate web;

(b) a controllable drive mechanism selectively and alternatively engageable with at least two of the webs for driving the selected web within its guide channel; and (c) means for selectively and alternately engaging the selected web to the controllable drive mechanism by pivoting the selected guide channel into contact with the controllable drive mechanism.

2. An apparatus for supplying a web to a processing station comprising:

(a) a first pivotable back guide plate and a first pivotable transport guide plate, the back guide plate and the transport guide plate defining a first pivotable guide channel therebetween in which the web is held and directed, the transport guide plate having an aperture formed therein;

(b) a fixed transport roller for driving the web, the fixed transport roller located so as to drivingly contact the web within the guide channel through the aperture in the transport guide plate when the guide channel is pivoted proximal to the transport roller; and (c) means for pivoting the first guide channel with respect to the transport roller.

3. The apparatus according to claim 2, wherein the transport roller is reversible for driving the driven web in a first direction into the processing station, and in a second direction for retracting the web from the processing station.

4. The apparatus according to claim 2, further comprising:

a second back guide plate and a second transport guide plate, which is define a second pivotable guide channel therebetween, the second guide channel being located on a side of the transport roller opposite the first pivotable guide channel for directing a second web to the processing station, said first and second guide channels and the interposed transport roller together forming a guide channel pair.

5. The apparatus according to claim 4, wherein the pivoting means of the first guide channel also pivots the second guide channel and is selectively engagable between the two guide channels.

6. The apparatus according to claim 5, wherein the plurality of guide channel pairs are superimposed.

7. The apparatus according to claim 5, further comprising:

a plurality of guide channel pairs arranged adjacent to each other.

8. The apparatus according to claim 7, wherein the pivoting means is constructed to allow only one guide channel to engage a transport roller at any one time.

9. The apparatus according to claim 8, wherein the pivoting means further comprises a cam-like selection roller interposed between each guide channel pair; and, means for jointly driving the cam-like selection rollers.

10. The apparatus according to claim 5, further comprising: means for resiliently coupling the back guide plates to corresponding transport guide plates.

11. The apparatus according to claim 10, wherein the coupling further comprises means for biasing the guide channels away from the transport roller.

12. The apparatus according to claim 5, further comprising a protuberance located between the back guide plates and the corresponding transport guide plates for blocking the guide channel for the web.

13. The apparatus according to claim 12, wherein the protuberance is affixed to at least one of the guide plates.

14. The apparatus according to claim 5, wherein the pivoting means further comprises:

a pivotable rocker arm for contacting the transport guide plate of a guide channel.

15. The apparatus according to claim 14, wherein the pivotable rocker arm is forked to provide a leg for contacting each guide channel of the guide channel pair.

16. The apparatus according to claim 15, wherein the pivoting means further comprises a controllable pivot pin attached to the rocker for pivoting the rocker into engagement with the guide channels.

17. The apparatus according to claim 5, further comprising:

(a) a back pressure roller for contacting the web;

(b) an opening formed in that guide plate distal to the transport roller for receiving a back pressure roller, the back pressure roller opening being narrower than the transport roller aperture of claim 2.

18. The apparatus according to claim 17, wherein the back pressure roller further comprises means for biasing the guide channel towards the transport roller.

19. The apparatus according to claim 5, wherein the pivoting means further comprises:

a cam-like selection roller having each guide channel as a follower.

20. The apparatus according to claim 19, further comprising:

a clamping rubber fittable between the back guide plate and its corresponding transport guide plate for frictionally engaging the web when the selection roller pivots the guide channel distally from the transport roller.

21. The apparatus according to claim 20, wherein the clamping rubber and the back pressure roller are attached to a lever on that guide channel side opposite the transport roller.

22. The apparatus according to claim 5, further comprising:

a pair of draw-in rollers located between the guide channels and the processing station for keeping the web taut.

23. The apparatus according to claim 22, further comprising a means for driving at least one of the draw-in rollers.

24. The apparatus according to claim 23, further comprising:

a drive coupling located in the driving means for coupling and uncoupling the drivable draw-in roller from the driving means during retraction of the web.

25. The apparatus according to claim 24, further comprising means for delivering an alternative web supply to the processing station apart from the guide channels.

26. The apparatus according to claim 25, wherein the alternative drive means further comprises:

(a) a pair of transport rollers for driving the alternative web;

(b) a drive motor for driving the transport rollers;

(c) a web detector for controlling the drive motor.

27. The apparatus according to claim 26, wherein the processing station is a printing means.

28. The apparatus according to claim 27, further comprising:

(a) means for separating a processed portion of the web from an unprocessed portion of the web;

(b) means for conveying the web out of the printing means before separation of the processed portion.

29. The apparatus of claim 5, further comprising a detector located in the path of the web-like material between the processing station and the ends of the guide channels for detecting the web-like material and producing control signals for forward and return transport of the web.

30. The apparatus of claim 5, wherein the drive mechanism further comprises stepping motors for driving the transport rollers.

31. The apparatus according to claim 5, wherein the plurality of guide channel pairs are juxtaposed.

* * * * *